US012473919B2

(12) United States Patent
Kawakami et al.

(10) Patent No.: US 12,473,919 B2
(45) Date of Patent: Nov. 18, 2025

(54) SCROLL COMPRESSOR

(71) Applicant: Mitsubishi Electric Corporation, Tokyo (JP)

(72) Inventors: Hayato Kawakami, Tokyo (JP); Kohei Tatsuwaki, Tokyo (JP); Kosuke Miyamae, Tokyo (JP)

(73) Assignee: Mitsubishiki Electric Corporation, Tokyo (JP)

( * ) Notice: Subject to any disclaimer, the term of this patent is extended or adjusted under 35 U.S.C. 154(b) by 0 days.

(21) Appl. No.: 18/855,378

(22) PCT Filed: Jun. 27, 2022

(86) PCT No.: PCT/JP2022/025533
§ 371 (c)(1),
(2) Date: Oct. 9, 2024

(87) PCT Pub. No.: WO2024/003981
PCT Pub. Date: Jan. 4, 2024

(65) Prior Publication Data

US 2025/0243860 A1 Jul. 31, 2025

(51) Int. Cl.
*F04C 18/02* (2006.01)
*F04C 23/00* (2006.01)
*F04C 29/12* (2006.01)

(52) U.S. Cl.
CPC ..... *F04C 18/0215* (2013.01); *F04C 23/008* (2013.01); *F04C 29/12* (2013.01); *F04C 2250/101* (2013.01)

(58) Field of Classification Search
CPC .... F04C 18/0215; F04C 23/008; F04C 29/12; F04C 2250/101
See application file for complete search history.

(56) References Cited

U.S. PATENT DOCUMENTS

2016/0131134 A1* 5/2016 Kakuda ..... F01C 1/0246 418/55.1
2019/0041106 A1* 2/2019 Piscopo ..... F04B 39/06
(Continued)

FOREIGN PATENT DOCUMENTS

JP 3045910 B2 * 5/2000
JP 6678811 B2 4/2020
(Continued)

OTHER PUBLICATIONS

Translation JP-3045910-B2 (Year: 2025).*
(Continued)

*Primary Examiner* — J. Todd Newton
(74) *Attorney, Agent, or Firm* — Posz Law Group, PLC

(57) ABSTRACT

In a scroll compressor, a suction port has an inlet portion in which a cross-sectional area of a flow passage therein decreases, and an outlet portion in which a cross-sectional area of the flow passage therein increases. A main frame has a first surface in which the upstream-side opening of the suction port is formed, and which is perpendicular to the rotation shaft, and a second surface opposite to the first surface. A boundary part between the inlet and outlet portions is closer to the second surface than an intermediate line between the first and second surfaces in an axial direction. A wall surface of the outlet portion that is located on an inner side in a radial direction perpendicular to the axial direction is an inclined surface that is inclined inwardly in the radial direction, in a direction from an upstream side toward a downstream side.

8 Claims, 11 Drawing Sheets

(56) References Cited

U.S. PATENT DOCUMENTS

| | | | | |
|---|---|---|---|---|
| 2023/0152185 | A1* | 5/2023 | Imanishi | F04B 51/00 62/131 |
| 2024/0410367 | A1* | 12/2024 | Okamoto | F04C 29/12 |

FOREIGN PATENT DOCUMENTS

| | | | | |
|---|---|---|---|---|
| WO | 2020/250337 | A1 | 12/2020 | |
| WO | WO-2021186499 | A1 * | 9/2021 | F04C 29/02 |

OTHER PUBLICATIONS

Translation WO-2021186499-A1 (Year: 2025).*
International Search Report of the International Searching Authority mailed Aug. 2, 2022 in corresponding International Patent Application No. PCT/JP2022/025533 (and English translation).

* cited by examiner

SCROLL COMPRESSOR

CROSS REFERENCE TO RELATED APPLICATION

This application is a U.S. national stage application of PCT/JP2022/025533 filed on Jun. 27, 2022, the contents of which are incorporated herein by reference.

TECHNICAL FIELD

The present disclosure relates to a scroll compressor that is mounted mainly in a refrigerating machine, an air-conditioning apparatus, or a water heater.

BACKGROUND ART

In the past, scroll compressors have been known to be used as a compressor for use in, for example, an air-conditioning apparatus, a refrigeration apparatus, or other apparatuses. For example, a scroll compressor disclosed in Patent Literature 1 includes a shell having a hermetically sealed space, a compression mechanism unit located in the shell to compress fluid, and a main frame fixed to an inner wall surface of the shell. The compression mechanism unit has a compression chamber defined by a combination of a stationary scroll and an orbiting scroll each of which has a scroll body protruding from its base plate. In the main frame, a suction port through which fluid is supplied into the compression chamber is provided as a space extending through the main frame in an up-down direction.

CITATION LIST

Patent Literature

Patent Literature 1: Japanese Patent No. 6678811

SUMMARY OF INVENTION

Technical Problem

In a compressor disclosed in Patent Literature 1 described above, a suction port is provided as a space extending through the main frame in the up-down direction. In such a compressor, unless the suction port has a proper shape, a pressure loss increases when fluid passes through the suction port, as a result of which the efficiency of the compressor is decreased. This is a problem regarding the performance of the compressor.

The present disclosure is applied to solve the above problems, and relates to a scroll compressor that can reduce the decrease of the efficiency of the compressor.

Solution to Problem

A scroll compressor according to an embodiment of the present disclosure includes: a shell; a compression mechanism unit provided in the shell, and including a compression chamber configured to compress fluid that is drawn in from a fluid intake; a drive mechanism unit configured to drive the compression mechanism unit; a rotation shaft configured to be rotated by a driving force generated in the drive mechanism unit; and a main frame having an outer circumferential surface that is in contact with and fixed to an inner wall surface of the shell, the main frame supporting the compression mechanism unit in an axial direction of the rotation shaft. In the main frame, a suction port is formed to guide fluid sucked into the shell to the compression chamber. The suction port is provided as a through hole formed in an outer circumferential portion of the main frame, or is defined by the inner wall surface of the shell and a groove formed in the outer circumferential surface of the main frame, the suction port having an inlet portion and an outlet portion, the inlet portion being formed such that a cross-sectional area of a flow passage in the inlet portion decreases from an upstream-side opening of the suction port, the outlet portion being formed continuously from the inlet portion to a downstream-side opening of the suction port such that a cross-sectional area of the flow passage in the outlet portion increases. The main frame has a first surface in which the upstream-side opening of the suction port is formed, the first surface being perpendicular to the rotation shaft, and a second surface that is located opposite to the first surface in the axial direction. A boundary part between the inlet portion and the outlet portion is located closer to the second surface than an intermediate line between the first surface and the second surface in the axial direction, and a wall surface of the outlet portion that is located on an inner side in a radial direction perpendicular to the axial direction is an inclined surface that is inclined inwardly in the radial direction, in a direction from an upstream side toward a downstream side.

Advantageous Effects of Invention

In the scroll compressor according to the embodiment of the present disclosure, the boundary part between the inlet portion and the outlet portion is located closer to the second surface side than the intermediate line between the first surface and the second surface in the axial direction. With this configuration, in the scroll compressor, the ratio of the inlet portion, where the cross-sectional area of the flow passage decreases, can be increased, and the inner wall surface of the inlet portion gradually changes, whereby the pressure loss of the fluid can be decreased. The wall surface of the outlet portion, located on the inner side in the radial direction perpendicular to the axial direction, is an inclined surface that is inclined inwardly in the radial direction in a direction from the upstream side toward the downstream side. With this configuration, in the scroll compressor, it is possible to cause the fluid flowing out from the outlet portion to flow toward the fluid intake, and thus improve a refrigerant intake efficiency. As a result of these advantages, the scroll compressor can reduce lowering of the efficiency of the compressor efficiency.

DESCRIPTION OF EMBODIMENTS

Figure 1:
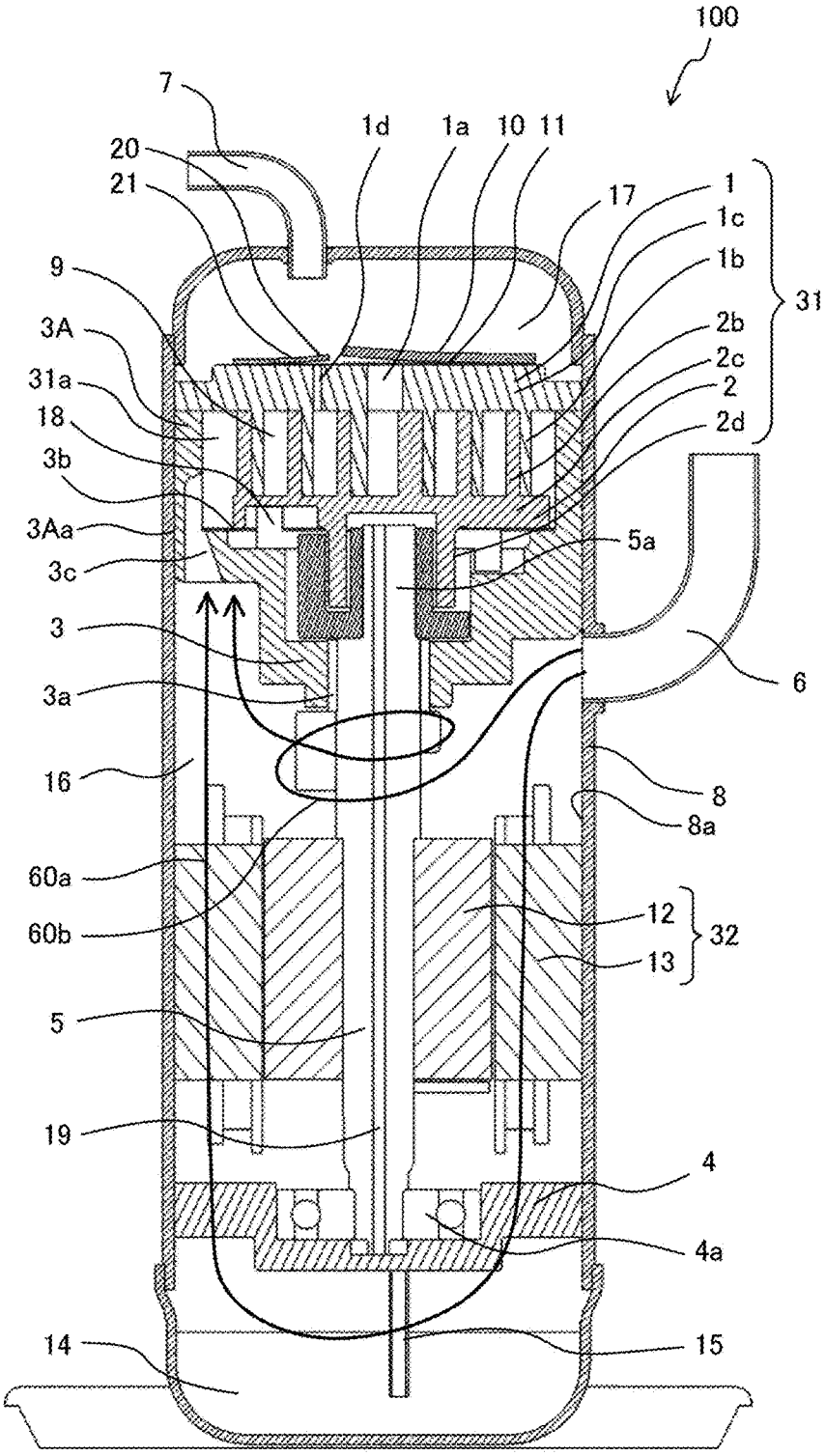
FIG. 1 is an explanatory diagram illustrating a section of a scroll compressor according to Embodiment 1.

Hereinafter, an embodiment of the present disclosure will be described with reference to the drawings. In each of figures in the drawings, components that are the same as or equivalent to those in a previous figure or previous figures are denoted by the same reference signs, and the same is true of the entire text of the specification. Furthermore, the configurations of components described in throughout the entire specification are each merely an example, and the present disclosure is not limited only by the descriptions in the specification. In addition, a relationship or relationships in size between components in the figures may differ from actual ones. Furthermore, the level of the temperature and pressure is not determined particularly in relation to an absolute value, but is determined relative to the states, operations, and other factors of a system, an apparatus, a device, etc.

Embodiment 1

FIG. 1 is an explanatory view illustrating a section of a scroll compressor 100 according to Embodiment 1. The scroll compressor 100 is a hermetically sealed scroll compressor that sucks fluid such as refrigerant, compresses the sucked fluid to change it into high-temperature and high-pressure fluid, and discharges the fluid. The scroll compressor 100 includes a shell 8 that is a hermetic container forming an outer casing thereof. The scroll compressor 100 is a low-pressure shell-type compressor that draws in sucked low-pressure fluid gas into an internal space of the shell 8 and then compresses this fluid gas. The shell 8 houses a compression mechanism unit 31 that compresses fluid, a drive mechanism unit 32 that drives the compression mechanism unit 31, a rotation shaft 5 that is rotated by a driving force generated in the drive mechanism unit 32, and other components.

As illustrated in FIG. 1, in the shell 8, the compression mechanism unit 31 is located above the drive mechanism unit 32, and the rotation shaft 5 extends in a vertical direction. A lower portion of the shell 8 serves as an oil reservoir 14. A suction pipe 6 and a discharge pipe 7 are connected to the shell 8. Through the suction pipe 6, fluid is sucked into the shell 8. Through the discharge pipe 7, the fluid is discharged to the outside of the shell 8. The suction pipe 6 is provided on a side surface of the shell 8. The discharge pipe 7 is provided on an upper surface of the shell 8. It should be noted that in the following descriptions, the direction in which the rotation shaft 5 extends is referred to as "axial direction," the direction perpendicular to the axial direction is referred to as "radial direction," and the direction in which the rotation shaft 5 is rotated is referred to as "circumferential direction."

The internal space of the shell 8 is divided into a low-pressure space 16 and a high-pressure space 17 based on the pressure of fluid that is present in this internal space. The low-pressure space 16 communicates with the suction pipe 6, and is a space in which low-pressure fluid is present before being drawn into a compression chamber 9 which will be described later. The high-pressure space 17 communicates with the discharge pipe 7, and is a space which high-pressure fluid discharged from the compression chamber 9 is present.

The compression mechanism unit 31 has a function of sucking low-pressure fluid that has flowed into the low-pressure space 16 through the suction pipe 6, compressing the sucked low-pressure fluid to change it into high-pressure fluid, and discharging the high-pressure fluid to the high-pressure space 17 in the shell 8. The high-pressure fluid discharged to the high-pressure space 17 is then discharged from the discharge pipe 7 to the outside of the scroll compressor 100. The drive mechanism unit 32 has a function of driving an orbiting scroll 2 included in the compression mechanism unit 31, such that the fluid is compressed by the compression mechanism unit 31. That is, the drive mechanism unit 32 drives the orbiting scroll 2 through the rotation shaft 5, so that the fluid is compressed by the compression mechanism unit 31.

The compression mechanism unit 31 includes a stationary scroll 1 and the orbiting scroll 2. As illustrated in FIG. 1, the orbiting scroll 2 and the stationary scroll 1 are provided such that the orbiting scroll 2 is located on a lower side and the stationary scroll 1 is located on an upper side. The stationary scroll 1 includes a stationary base plate 1*c* and a stationary scroll body 1*b* that is a scroll wrap provided on one side of the stationary base plate 1*c*. The orbiting scroll 2 includes an orbiting base plate 2*c* and an orbiting scroll body 2*b* that is a scroll wrap provided on one side of the orbiting base plate 2*c*. The stationary scroll 1 and the orbiting scroll 2 are fitted inside the shell 8, with the stationary scroll body 1*b* and the orbiting scroll body 2*b* engaged with each other.

The compression chamber 9 configured to compress the fluid is defined between the stationary scroll body 1*b* and the orbiting scroll body 2*b*. A fluid intake 31*a* is provided between a scroll end point of one of the stationary scroll body 1*b* and the orbiting scroll body 2*b* and an outer circumferential surface of the other of those scroll bodies. The compression mechanism unit 31 compresses the fluid drawn in from the fluid intake 31*a*, in the compression chamber 9. The stationary scroll body 1*b* and the orbiting scroll body 2*b* are formed to extend along an involute curve, an algebraic spiral curve, or other curves.

The stationary scroll 1 is fixed to the shell 8, with the main frame 3 interposed therebetween, or is directly fixed to the shell 8 by shrink fit. At a central portion of the stationary scroll 1, a discharge port 1*a* is provided to allow the fluid compressed to be changed into high-pressure fluid to be discharged. At an outlet opening of the discharge port 1*a*, a discharge valve 11 is provided. The discharge valve 11 is made of plate spring and covers this outlet opening to prevent backflow of the fluid. On one end side of the discharge valve 11, a discharge valve retainer 10 is provided to limit the lift amount of the discharge valve 11. To be more specific, when the fluid is compressed to change into high-pressure fluid, in the compression chamber 9, the discharge valve 11 is lifted against its elastic force, and the high-pressure fluid is then discharged from the discharge port 1*a* into the high-pressure space 17. The discharge valve 11 is regulated by the discharge valve retainer 10 not to be deformed more than necessary. Thus, the discharge valve 11 is prevented from being broken.

In the stationary scroll 1, a sub-port 1*d* is provided in addition to the discharge port 1*a*. The sub-port 1*d* communicates with the high-pressure space 17 and the compression chamber 9. At an outlet opening of the sub-port 1*d*, a sub-port valve 21 is provided. The sub-port valve 21 is made of a plate spring and covers this outlet opening to prevent backflow of the fluid. On one end side of the sub-port valve 21, a sub-port valve retainer 20 is provided to limit the lift amount of the sub-port valve 21. That is, when the fluid is compressed to change into high-pressure fluid during a compression process in the compression chamber 9, the sub-port valve 21 is lifted against its elastic force, and the high-pressure fluid is then discharged from the sub-port 1*d* into the high-pressure space 17. The sub-port valve 21 is regulated by the sub-port valve retainer 20 not to be deformed more than necessary. The sub-port valve 21 is prevented from being broken.

The orbiting scroll 2 is made to perform eccentric rotary motion relative to the stationary scroll 1 by an Oldham ring 18 without rotating about its own axis. The Oldham ring 18 will be described later. On a central portion on the other surface (hereinafter referred to as "thrust surface") of the orbiting scroll 2, an orbiting bearing portion 2*d* having a hollow cylindrical shape is formed. The rotation shaft 5 includes an eccentric portion 5*a* fitted into the orbiting bearing portion 2*d*, with a slight gap provided between the eccentric portion 5*a* and the inner surface of the orbiting bearing portion 2*d*. The eccentric portion 5*a* will be described later. The thrust surface of the orbiting scroll 2 supports a thrust load. A thrust bearing 3*b* is provided at this thrust surface.

The drive mechanism unit 32 includes at least a stator 13 and a rotor 12. The stator 13 is held while being fixed to the inside of the shell 8. The rotor 12 is provided rotatably on an inner circumferential side of the stator 13 and fixed to the rotation shaft 5. The stator 13 has a function of rotationally driving the rotor 12 upon being energized. An outer circumferential surface of the stator 13 is fixedly supported by the shell 8 by shrink fit, spot welding, or other method. The rotor 12 is rotationally driven upon energization of the stator 13, and has a function of rotating the rotation shaft 5. The rotor 12 is fixed to the outer circumference of the rotation shaft 5, has permanent magnets therein, and is held, with a slight gap provided between the rotor 12 and the stator 13.

The main frame 3 and the sub-frame 4 are fixedly attached to the inside of the shell 8. The main frame 3 is located below the compression mechanism unit 31. The main frame 3 has a cylindrical outer wall 3A extending in the axial direction. The outer wall 3A includes an outer circumferential surface 3Aa that is in contact with and fixed to an inner wall surface 8*a* of the shell 8. The outer circumferential surface 3Aa of the main frame 3 is fixedly attached to the inner wall surface 8*a* of the shell 8 by, for example, shrink fit or welding. The main frame 3 has, at its central portion, a through hole through which the rotation shaft 5 passes. A main bearing 3*a* is provided in the through hole. The main bearing 3*a* is, for example, a slide bearing. While supporting the orbiting scroll 2 in the axial direction, the main frame 3 supports the rotation shaft 5 that the rotation shaft 5 is rotatable by the main bearing 3*a*.

In an outer circumferential portion of the main frame 3, a suction port 3*c* is formed through which a space in the main frame 3 communicates with the low-pressure space 16 located below the main frame 3. The suction port 3*c* is a through hole that extends through the main frame 3 in the axial direction. Low-pressure fluid that is present in the low-pressure space 16 is sucked into the compression chamber 9 through the suction port 3*c* and the fluid intake 31*a*. In FIG. 1, arrows 60*a* and 60*b* indicate respective flows of fluid that flows to the suction port 3*c* after flowing from the suction pipe 6 into the shell 8. To be more specific, the arrow 60*a* indicates a flow in which the fluid having flowed from the suction pipe 6 into the shell 8 flows downward through a gap provided in the drive mechanism unit 32 from an upper side to a lower side while cooling the drive mechanism unit 32, then flows upward from the bottom through another gap formed in the drive mechanism unit 32 from the lower side to the upper side, and reaches the suction port 3*c*. The arrow 60*b* indicates a flow in which the fluid having flowed from the suction pipe 6 into the shell 8 turns around the rotation shaft 5, and then reaches the suction port 3*c*.

The sub-frame 4 is located below the drive mechanism unit 32, and fixedly attached to the inner wall surface 8*a* of the shell 8 by, for example, shrink fit or welding. The sub-frame 4 has a through hole, at its central portion, through which the rotation shaft 5 passes. A sub-bearing 4*a* is provided at the through hole. The sub-bearing 4*a* is, for example, a ball bearing. The sub-frame 4 supports the rotation shaft 5 such that the sub-frame 4 is rotatable by the sub-bearing 4*a*.

As the rotor 12 rotates, the rotation shaft 5 rotates to cause the orbiting scroll 2 to perform eccentric rotary motion. The upper side of the rotation shaft 5 is rotatably supported by the main bearing 3*a*, and the lower side of the rotation shaft 5 is rotatably supported by the sub-bearing 4*a*. At an upper end portion of this rotation shaft 5, the eccentric portion 5*a* is fitted into the orbiting bearing portion 2*d* such that the orbiting scroll 2 is eccentrically rotatable.

An oil pump 15 is fixedly attached to a lower portion of the rotation shaft 5. The oil pump 15 is a positive-displacement pump. The oil pump 15 has a function of supplying refrigerating machine oil stored in the oil reservoir 14 to the orbiting bearing portion 2*d*, the main bearing 3*a*, the thrust bearing 3*b*, the sub-bearing 4*a*, etc., through an oil circuit 19 provided in the rotation shaft 5, as the rotation shaft 5 rotates.

In the shell 8, the Oldham ring 18 is provided to prevent the orbiting scroll 2 from rotating about its own axis during its eccentric rotary motion. The Oldham ring 18 has a function of preventing the orbiting scroll 2 from rotating about its own axis, and enabling the orbiting scroll 2 to perform orbital motion. Although referring to FIG. 1, the Oldham ring 18 is provided between the orbiting scroll 2 and the main frame 3, the Oldham ring 18 can also be provided between the orbiting scroll 2 and the stationary scroll 1.

Operation of the scroll compressor 100 will be described briefly. When electricity is supplied to a power-supply terminal (not illustrated) provided at the shell 8, a torque is generated in the stator 13 and the rotor 12, thereby rotating the rotation shaft 5. Rotation of the rotation shaft 5 is transmitted to the orbiting scroll 2 via the eccentric portion 5*a*. When the orbiting scroll 2 is given a rotational driving force, rotation of the orbiting scroll 2 about the own axis thereof is restricted by the Oldham ring 18, and instead, the orbiting scroll 2 performs eccentric rotary motion.

As the orbiting scroll 2 performs eccentric rotary motion, gas fluid sucked into the low-pressure space 16 in the shell 8 from the suction pipe 6 passes through the suction port 3*c* formed in the main frame 3 and is sucked into the compression chamber 9. The compression chamber 9 compresses the fluid therein by reducing its volume while moving in the direction from the outer circumferential portion toward the center along with the eccentric rotary motion of the orbiting scroll 2. The fluid compressed in the compression chamber 9 is discharged from the discharge port 1*a* provided in the stationary scroll 1 into the high-pressure space 17 against the operation of the discharge valve 11, and is then discharged from the discharge pipe 7 to the outside of the shell 8. When the fluid is compressed such that its pressure changes to a high pressure during the compression process, the compressed fluid is discharged from the sub-port 1*d* provided in the stationary scroll 1 into the high-pressure space 17 against the operation of the sub-port valve 21, and is then discharged from the discharge pipe 7 to the outside of the shell 8.

Figure 2:
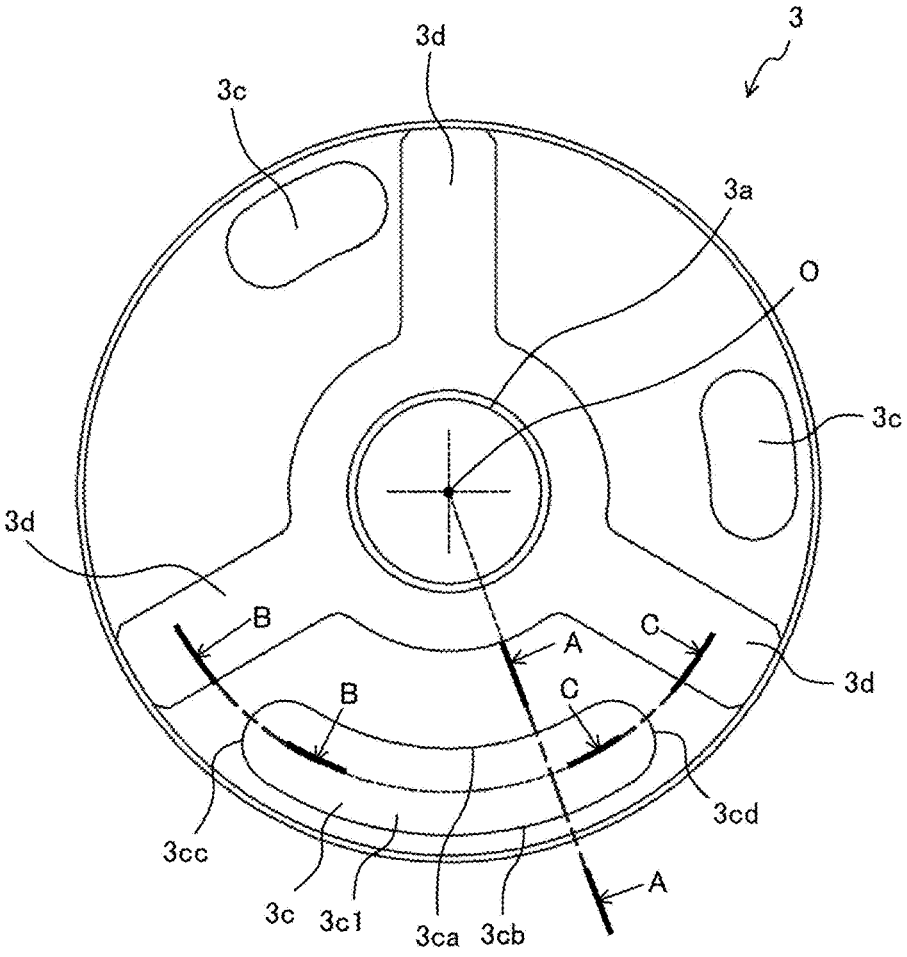
FIG. 2 is a plan view illustrating a main frame of the scroll compressor according to Embodiment 1 as the main frame is viewed from a sub-frame as illustrated in FIG. 1.
Figure 3:
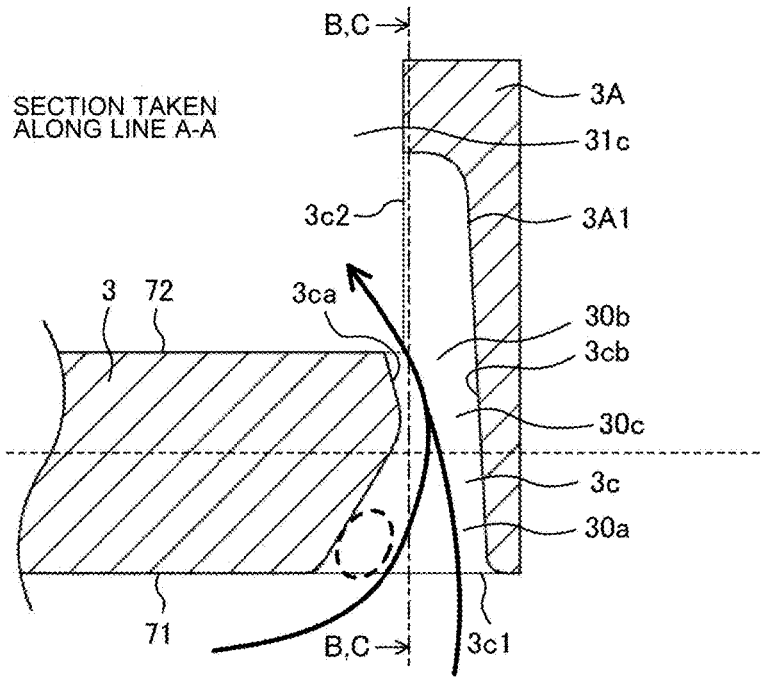
FIG. 3 is a sectional view of the main frame of the scroll compressor according to Embodiment 1 that is taken along a plane including a shaft center of a rotation shaft.

FIG. 2 is a plan view illustrating the main frame 3 of the scroll compressor 100 according to Embodiment 1 as the main frame 3 is viewed from the sub-frame 4 that is provided as illustrated in FIG. 1. FIG. 3 is a sectional view of the main frame 3 of the scroll compressor 100 according to Embodiment 1 that is taken along line A-A in FIG. 2, as viewed in a direction indicated by arrows. In other words, FIG. 3 is a sectional view of the main frame 3 according to Embodiment 1 that is taken along a plane including a shaft center O of the rotation shaft 5. The up-down direction in FIG. 3 coincides with the up-down direction in FIG. 1. In FIG. 3, a dash-dot line indicates part of the main frame that is cut along line B-B and line C-C in FIG. 2.

As illustrated in FIG. 2, suction ports 3*c* are provided in the outer circumferential portion of the main frame 3. Specifically, the suction ports 3*c* are provided outside the orbiting base plate 2*c* (see FIG. 1) of the orbiting scroll 2 such that the suction ports 3*c* do not overlap the orbiting base plate 2*c* as viewed in the axial direction. This is intended to prevent the suction ports 3*c* from being covered by the orbiting base plate 2*c*. The main frame 3 is also provided with rib portions 3*d* to fix the main frame 3 to a work table during processing. The suction ports 3*c* are provided in such a manner as to avoid the rib portions 3*d*.

The suction port 3*c* has a hole that is defined by two wall surfaces 3*ca* and 3*cb* that are located opposite to each other in the radial direction and by two wall surfaces 3*cc* and 3*cd* that are located opposite to each other in the circumferential direction. Each of the wall surfaces 3*ca* and 3*cb* is formed in the shape of an arc extending in the circumferential direction. The wall surface 3*cc* is formed in the shape of an arc connecting one end of the wall surface 3*ca* and one end of the wall surface 3*cb* on the same side in the circumferential direction. The wall surface 3*cd* is formed in the shape of an arc connecting the other end of the wall surface 3*ca* and the other end of the wall surface 3*cb* on the same side in the circumferential direction. The wall surfaces 3*ca*. 3*cd*, 3*cb*, and 3*cc* connect to each other in this order, forming the inner wall surface of the suction port 3*c*. As illustrated in FIG. 3, the suction port 3*c* further includes a groove 3A1 formed in the outer wall 3A of the main frame 3. The groove 3A1 is continuously formed along the wall surface 3*cb*. A downstream end of the groove 3A1 is formed in a rounded shape.

A thick arrow in FIG. 3 indicates the flow of fluid sucked into the suction port 3*c*. The suction port 3*c* includes an upstream-side opening 3*c*1 and a downstream-side opening 3*c*2. The upstream-side opening 3*c*1 is an opening of the suction port 3*c* at an upstream end thereof. The downstream-side opening 3*c*2 is an opening of the suction port 3*c* at a downstream end thereof. The main frame 3 has a first surface 71 and a second surface 72 that are perpendicular to the rotation shaft 5 and opposite to each other in the axial direction. The upstream-side opening 3*c*1 is formed in the first surface 71. The downstream-side opening 3*c*2 is formed extending from the second surface 72 over the inner wall surface of the outer wall 3A.

FIG. 3 illustrates a configuration in which the main frame 3 includes the outer wall 3A and part of the downstream-side opening 3*c*2 is formed in the outer wall 3A; however, the scroll compressor 100 in Embodiment 1 may be configured such that no outer wall is provided, that is, the main frame 3 does not include the outer wall 3A. In the case where the scroll compressor 100 has no outer wall, the suction port 3*c* does not have the groove 3A1. In the case where the scroll compressor 100 has no outer wall, the upstream-side opening 3*c*1 is formed in the first surface 71, and the downstream-side opening 3*c*2 is formed in the second surface 72.

The suction port 3*c* forms a flow passage whose cross-sectional area increases after decreasing from the upstream-side opening 3*c*1 toward the downstream side. The cross-sectional area of the flow passage means the area of a cross-section perpendicular to the flow direction of the fluid (axial direction). A portion of the suction port 3*c*, whose cross-sectional area of the flow passage decreases from the upstream-side opening 3*c*1, will hereinafter be referred to as "inlet portion 30*a*," and a portion of the suction port 3*c*, whose cross-sectional area of the flow passage decreases from the inlet portion 30*a* toward the downstream-side opening 3*c*2, will hereinafter be referred to as "outlet portion 30*b*."

In the inlet portion 30*a* of the suction port 3*c*, the cross-sectional area of the flow passage continuously decreases from the upstream side to the downstream side. Since the cross-sectional area of the flow passage continuously decreases, the degree to which the flow of fluid that passes through the suction port 3*c* separates from the wall surface 3*ca* is reduced in a region circled by a dotted line in FIG. 3, thereby reducing a pressure loss of the fluid that is caused by the above separation. In the suction port 3*c*, since the downstream end of the groove 3A1 is formed in a rounded shape, it is possible to reduce the degree of separation of the flow of fluid that passes through the suction port 3*c*, from the inner wall surface of the groove 3A1.

In the suction port 3*c*, a boundary part 30*c* between the inlet portion 30*a* and the outlet portion 30*b* is located closer to the second surface 72 than an intermediate line between the first surface 71 and the second surface 72 in the axial direction. A dotted line extending in a lateral direction in FIG. 3 is the intermediate line between the first surface 71 and the second surface 72 in the axial direction. With the above configuration, in the scroll compressor 100, the ratio of the inlet portion 30*a*, where the cross-sectional area of the flow passage decreases, in the suction port 3*c*, can be increased, and the inner wall surface of the inlet portion 30*a* gradually changes, whereby the pressure loss of the fluid can be decreased.

The wall surface 3*ca* of the outlet portion 30*b*, which is located on the inner side in the radial direction, is an inclined surface that is inclined inwardly in the radial direction as this wall surface 3*ca* extends from the upstream side toward the downstream side. With this configuration, in the scroll compressor 100, the fluid flowing out from the outlet portion 30*b* can be made to flow toward the fluid intake 31*a*, and a refrigerant intake efficiency can be increased. It should be noted that as the flow in which the fluid having flowed from the suction pipe 6 into the shell 8 flows to the suction port 3*c*, as described above, the flow indicated by the arrow 60*a* and the flow indicated by the arrow 60*b* are present as described above. The wall surface 3*ca* is an inclined surface as described above. This is effective, especially for the flow indicated by the arrow 60*a*. This is because in the flow indicated by the arrow 60*a*, the fluid flows into the suction port 3*c* in a direction parallel to the axial direction as indicated in FIG. 1. Thus, if the wall surface 3*ca* is a vertical surface, the fluid flows parallel to the axial direction, and does not flow toward the fluid intake 31*a*. In contrast, in the scroll compressor 100, since the wall surface 3*ca* is the inclined surface, fluid that flows into the suction port 3*c* in the direction parallel to the axial direction can be changed and made to flow toward the fluid intake 31*a*.

In the scroll compressor 100, it is possible to reduce the pressure loss of the fluid in the inlet portion 30*a*, and fluid flowing out from the outlet portion 30*b* is made to flow toward the fluid intake 31*a*. By virtue of a combination of those advantages, it is possible to reduce lowering of the efficiency of the compressor.

Although it is described above that in the suction port 3*c*, the cross-sectional area of the flow passage in the inlet portion 30*a* continuously decreases, this cross-sectional area of the flow passage is evaluated quantitatively in relation to the design of the suction port 3*c*.

Figure 4:
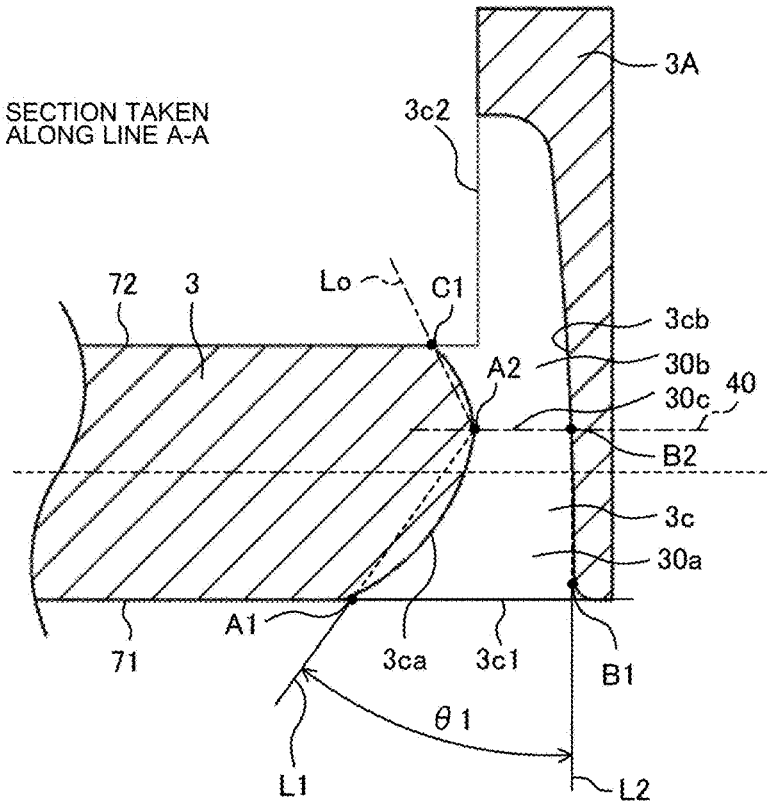
FIG. 4 is another sectional view of the main frame of the scroll compressor according to Embodiment 1 that is take along the plane including the shaft center of the rotation shaft.

FIG. 4 is a sectional view of the main frame 3 of the scroll compressor 100 according to Embodiment 1 that is taken along a plane including the shaft center O of the rotation shaft 5. In other words, FIG. 4 is a sectional view of the main frame 3 that is taken along line A-A in FIG. 2, as viewed in the direction indicated by arrows.

In the section as illustrated in FIG. 4, of two wall surfaces that are opposite to each other in the radial direction, on the wall surface 3*ca* located on the inner side in the radial direction, an inlet end and an outlet end of the inlet portion 30*a* are a point A1 and a point A2, respectively. In the section as illustrated in FIG. 4, of the two opposite wall surfaces, on the wall surface 3*cb* located on the outer side in the radial direction, an inlet end and an outlet end of the inlet portion 30*a* are a point B1 and a point B2, respectively. The point A2 is also the intersection of a cut plane 40 and the wall surface 3*ca*. The point B2 is also the intersection of the cut plane 40 and the wall surface 3*cb*, at which the cross-sectional area of the flow passage of the suction port 3*c* is minimized. The cut plane 40 is perpendicular to the rotation shaft 5 at a position in the axial direction where the cross-sectional area of the flow passage of the suction port 3*c* is the minimum. The cut plane 40 can also be perpendicular to the rotation shaft 5 at the boundary part 30*c* between the inlet portion 30*a* and the outlet portion 30*b*.

The angle between a straight line L1 connecting the points A1 and A2 and a straight line L2 connecting the points B1 and B2 is θ1. It should be noted that if the cross-sectional area of the flow passage of the suction port 3*c* at the upstream end thereof, that is, the cross-sectional area of the flow passage at the upstream-side opening 3*c*1, is the minimum, neither the straight lines L1 and L2 nor the angle θ1 between the straight lines L1 and L2 is defined. Of the two wall surfaces opposite to each other in the radial direction, on the wall surface 3*ca* located on the inner side in the radial direction, an outlet end of the outlet portion 30*b* is a point C1, and a straight line connecting the points A2 and C1 is Lo.

If the angle θ1 is κ degrees and the cross-sectional area of the flow passage of the suction port 3*c* in the inlet portion 30*a* does not change from the upstream-side opening 3*c*1 to the cut plane 40, the flow of fluid in the inlet portion 30*a* relatively greatly separates from the wall surface 3*ca*, as a result of which the pressure loss of the fluid that is caused by the separation increases. In contrast, where the angle θ1 is larger than 0 degrees, the degree of separation of the flow of fluid that flows from the wall surface 3*ca* can be reduced and the pressure loss of the fluid can be reduced, as compared with the case where the angle θ1 is 0 degrees.

Figure 5:
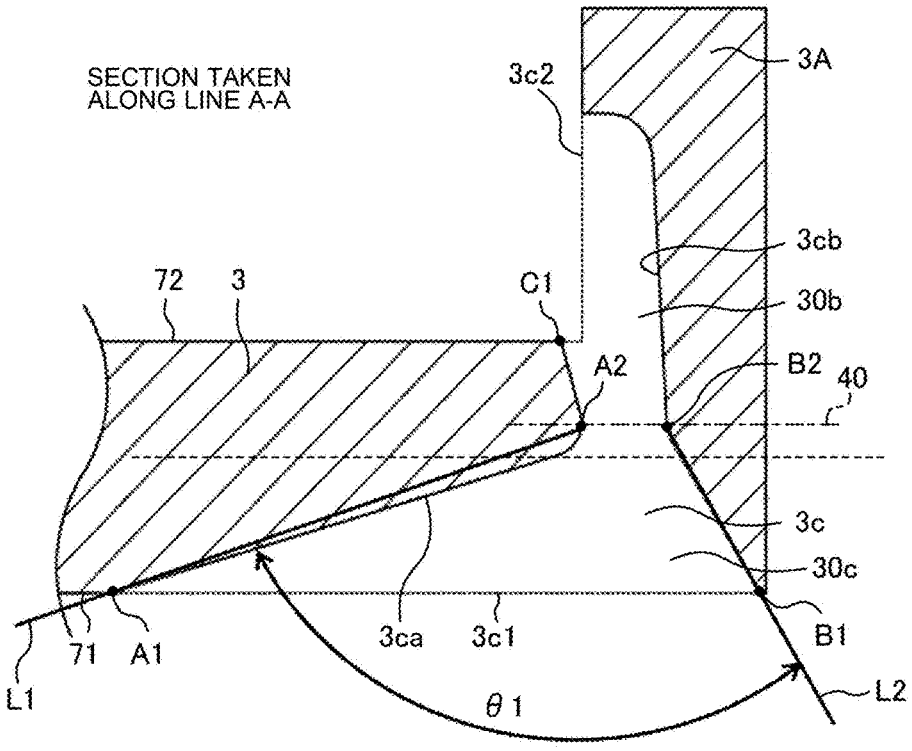
FIG. 5 illustrates another example of a suction port in the scroll compressor according to Embodiment 1.

It should be noted that referring to FIG. 4, a portion of the wall surface 3*cb* of the suction port 3*c* that forms the inlet portion 30*a* extends in substantially the vertical direction, and the straight line L2 extends in substantially the vertical direction; however, the straight line L2 may be inclined to the vertical direction as illustrated in FIG. 5.

FIG. 5 illustrates another example of the suction port 3*c* in the scroll compressor 100 according to Embodiment 1. In this example, that portion of the wall surface 3*cb* of the suction port 3*c* that forms the inlet portion 30*a* is inclined inwardly in the radial direction, in the direction from the upstream-side opening 3*c*1 toward the downstream side. Accordingly, the straight line L2 is also inclined inwardly in the radial direction, in the direction from the upstream-side opening 3*c*1 toward the downstream side. In such a manner, the straight line L2 may be inclined to the vertical direction.

Basically, in many cases, the main frame 3 provided in the scroll compressor 100 is manufactured by casting, and in order to remove a molded product from a die, a draft angle is set for the suction port 3*c*. However, the angle θ1 is set smaller than 12 degrees as a draft angle that is set in order to remove a molded product from a die, and this angle insufficient in view of the pressure loss. Therefore, in the scroll compressor 100, the lower limit of the angle θ1 that is set to decrease the pressure loss is set larger than or equal to than 12 degrees.

In the scroll compressor 100, the upper limit of the angle θ1 is set to a value obtained by adding an angle attributable to, for example, manufacturing errors to θ1=90 degrees in the case where the inlet portion 30*a* has a chamfered shape. In terms of an inlet loss calculated by the Weisbach formula, a loss coefficient in the case where θ1=90 degrees is reduced to one-half, as compared with the case where the angle θ1=0 degrees, although the Weisbach formula applies to incompressible fluids. A pressure loss of the fluid in the suction port 3*c* can be calculated by multiplying the flow rate of the fluid by a loss coefficient. Thus, in the case where the angle θ1=90 degrees, the scroll compressor 100 can reduce the loss coefficient to one-half, as compared with the case where θ1=0 degrees, and can therefore decrease the pressure loss of the fluid in the suction port 3*c*. In view of the above, the upper limit of the angle θ1 is set at 100 degrees by adding an angle of 10 degrees attributable to, for example, the manufacturing errors to θ1=90 degrees. That is, the angle θ1 is set larger than or equal to 12 degrees and smaller than or equal to 100 degrees.

In the above section as illustrated in FIG. 3 as an example, the wall surfaces defining the suction port 3*c* are linearly, and in the section illustrated in FIG. 4, the wall surfaces defining the suction port 3*c* are formed in such a manner to protrude. Specifically, part of the wall surface 3*ca* that is located from the point A1 to the point A2 is formed in the shape of a curve protruding outwardly in the radial direction relative to the straight line L1. In addition, part of the wall surface 3*ca* that is located from the point A2 to the point C1 is formed in the shape of a curve protruding outwardly in the radial direction relative to the straight line Lo. Since the wall surface 3*ca* is formed in such a manner as described above, it is possible to reduce occurrence of pressure loss caused by the fluid separation. The wall surfaces located upstream and downstream of the boundary at the point A2 are smoothly continuous with each other at the point A2. Also in this regard, it is possible to reduce occurrence of pressure loss caused by the separation of the fluid.

In the above descriptions, the angle θ1 formed at the section taken along the plane including the shaft center O of the rotation shaft 5 is defined. Subsequently, an angle θ2 at the section taken along the curved surface formed in the shape of the imaginary cylinder having the rotation shaft 5 as the central axis will be defined.

Figure 6:
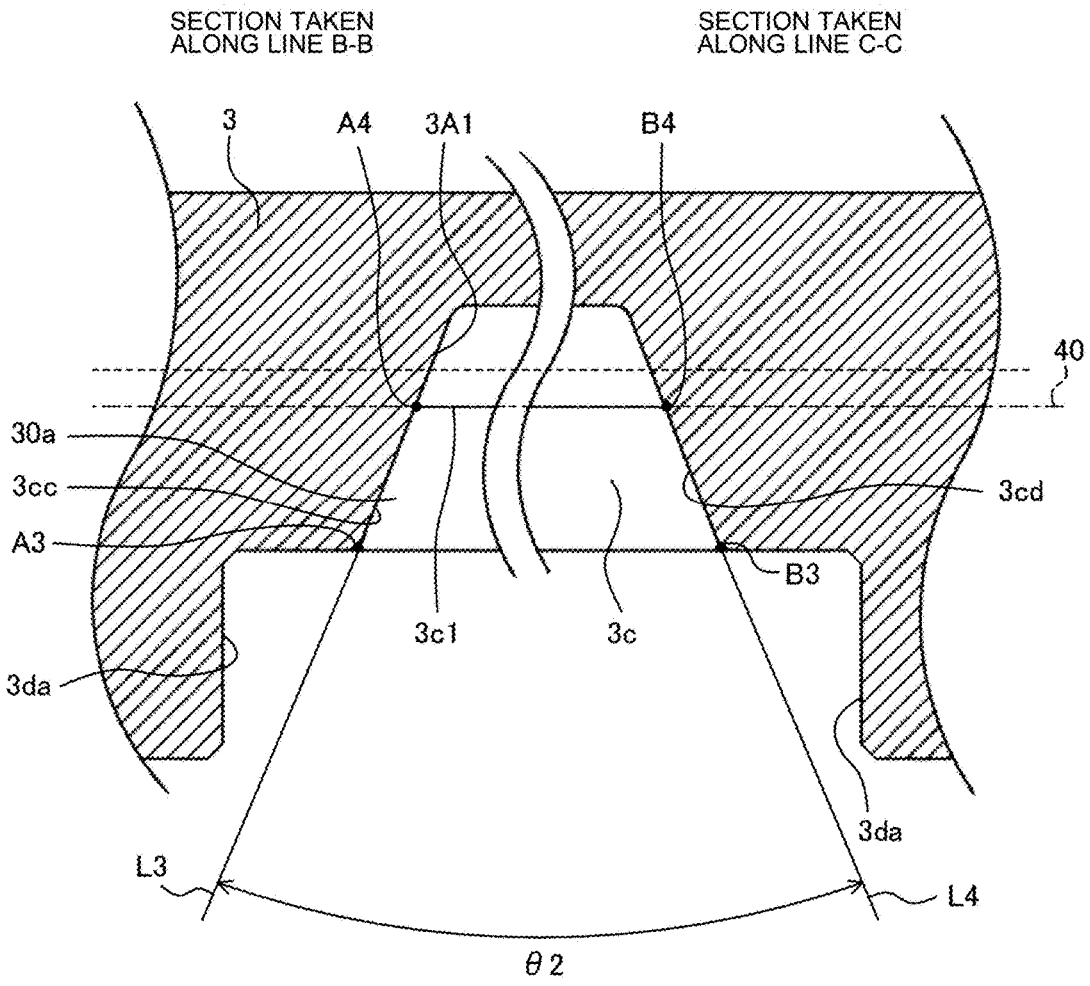
FIG. 6 is a sectional view of the main frame of the scroll compressor according to Embodiment 1 that is taken along a curved surface formed in the shape of an imaginary cylinder having the rotation shaft as a central axis.

FIG. 6 is a sectional view of the main frame 3 of the scroll compressor 100 according to Embodiment 1 that is taken along the curved surface formed in the shape of the imaginary cylinder having the rotation shaft 5 as the central axis. In other words, FIG. 6 illustrates a B-B section that is taken along line B-B in FIG. 2, as viewed in the direction indicated by the arrows, and a C-C section that is taken along line C-C in FIG. 2, as viewed in directions indicated by arrows. In FIG. 6, the B-B section and the C-C section are illustrated side by side. In the section as illustrated in FIG. 6, wall surfaces 3*da* are illustrated as side surfaces (see FIG. 2) of the rib portions 3*d* that extend in the radial direction. In the sections as illustrated in FIG. 6, a dotted line extending in the lateral direction indicates the position of the second surface 72 of the main frame 3 in a height direction.

In the sections as illustrated in FIG. 6, on the wall surface 3*cc* which is one of the two wall surfaces that are opposite to each other in the circumferential direction, an inlet end and an outlet end of the inlet portion 30*a* are a point A3 and a point A4, respectively. In the sections as illustrated in FIG. 6, on the wall surface 3*cd* which is the other of the two opposite wall surfaces, an inlet end and an outlet end of the inlet portion 30*a* are a point B3 and a point B4, respectively. The point A4 is also the intersection of the cut plane 40 and the wall surface 3*cc*, at which the cross-sectional area of the flow passage of the suction port 3*c* is minimized. The point B4 is also the intersection of the cut plane 40 and the wall surface 3*cd*, at which the cross-sectional area of the flow passage of the suction port 3*c* is the minimum. The angle between a straight line L3 connecting the points A3 and A4 and a straight line L4 connecting the points B3 and B4 is θ2.

In the section as illustrated in FIG. 6, the wall surfaces 3*cc* and 3*cd* are straight, the straight line L3 extends along the wall surface 3*cc* in the inlet portion 30*a*, and the straight line L4 extends along the wall surface 3*cd* in the inlet portion 30*a*. It should be noted that in the case where the sectional area of the upstream end of the suction port 3*c*, that is, the sectional area of the upstream-side opening 3*c*1, is the minimum, the straight lines L3 and L4 and the angle θ2 between these straight lines are not defined.

The angle θ2 is set larger than or equal to than 12 degrees and smaller than or equal to than 100 degrees for the same reasons as the angle θ1.

In the scroll compressor 100 according to Embodiment 1, it suffices that one or both of the angles θ1 and θ2 are larger than or equal to 12 degrees and smaller than or equal to 100 degrees. With this configuration, in the scroll compressor 100, it is possible to reduce separation of the flow of fluid that is sucked into the suction port 3*c*, and thus decrease the pressure loss of the fluid that is caused by the separation.

Figure 7:
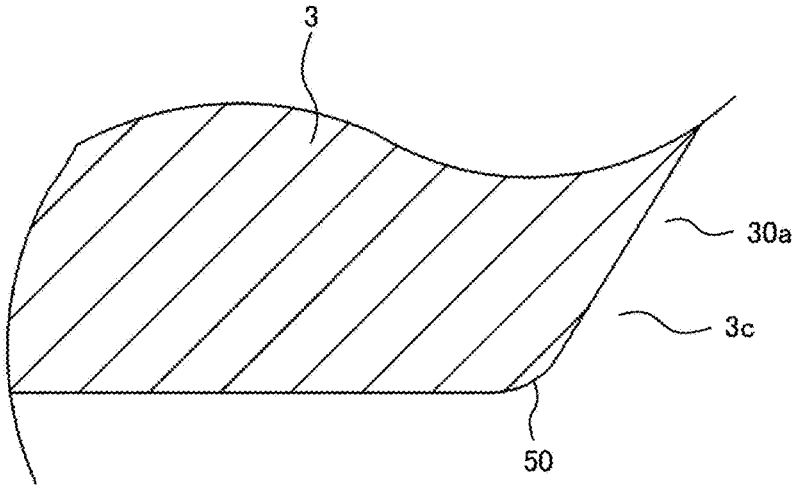
FIG. 7 is an enlarged sectional view of an inlet portion of the suction port as illustrated in any of FIGS. 3 to 6.

FIG. 7 is an enlarged sectional view of the inlet portion 30*a* of the suction port 3*c* as illustrated in any of FIGS. 3 to 6. It is preferable that an inlet corner portion 50 be formed in a rounded shape as illustrated in FIG. 7 to reduce separation of the flow of fluid in the inlet portion 30*a* of the suction port 3*c*. In terms of the inlet loss calculated by the Weisbach formula, a loss coefficient in the case where the inlet corner portion 50 is formed in a rounded shape is greatly decreased, as compared with the case where the inlet corner portion 50 be shaped right-angled. Accordingly, it is preferable that the inlet corner portion 50 be formed in a rounded shape.

It is preferable that the radius of curvature of the inlet corner portion 50 formed in a rounded shape be larger than or equal to 1 mm. This is because the JIS indicates a rough standard of the size of the corner portion for manufacturing of castings, and specifies 1 mm as the minimum value thereof. It should be noted that this dimension of 1 mm is set for the reason that a casting and a casting die may be damaged if the radius of curvature R is smaller than 1 mm.

The upper limit of the radius of curvature R is set depending on the size of the suction port 3*c*. In order to ensure that the inlet corner portion 50 has a quadrant shape or a nearly quadrant shape as its rounded shape, the upper limit of the radius of curvature R is set to a value calculated by the following formula, where D is the inside diameter of the shell 8.

$$\text{Radius of curvature } R < D/4$$

It should be noted that regarding the scroll compressor 100 according to Embodiment 1, the above description refers to a configuration in which the stationary scroll 1 is fixedly attached to the main frame 3 that is fixedly attached to the shell 8. However, the scroll compressor 100 according to Embodiment 1 may be configured such that the stationary scroll 1 and the main frame 3 are individually fixedly attached to the shell 8. That is, the scroll compressor 100 according to Embodiment 1 may be a scroll compressor 100 having no frame outer wall.

In the scroll compressor 100 according to Embodiment 1, the suction port 3*c* is a through hole that extends through the main frame 3. However, as illustrated in FIG. 7, which will be described below, the suction port 3*c* may be a groove formed in the outer circumferential surface 3Aa of the main frame 3.

Figure 8:
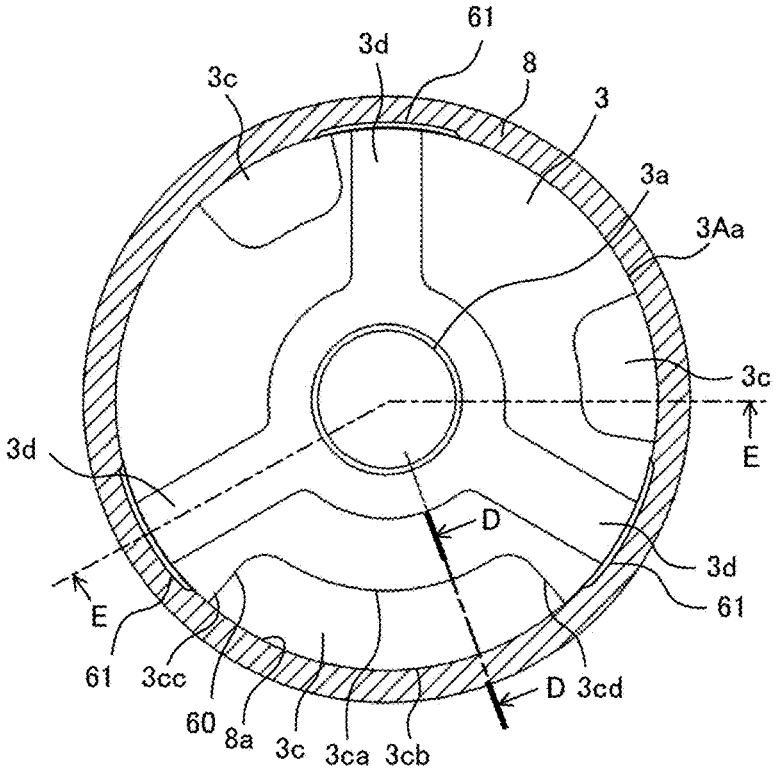
FIG. 8 illustrates a modification of the scroll compressor according to Embodiment 1 as the main frame fixed to a shell is viewed from a lower side.
Figure 9:
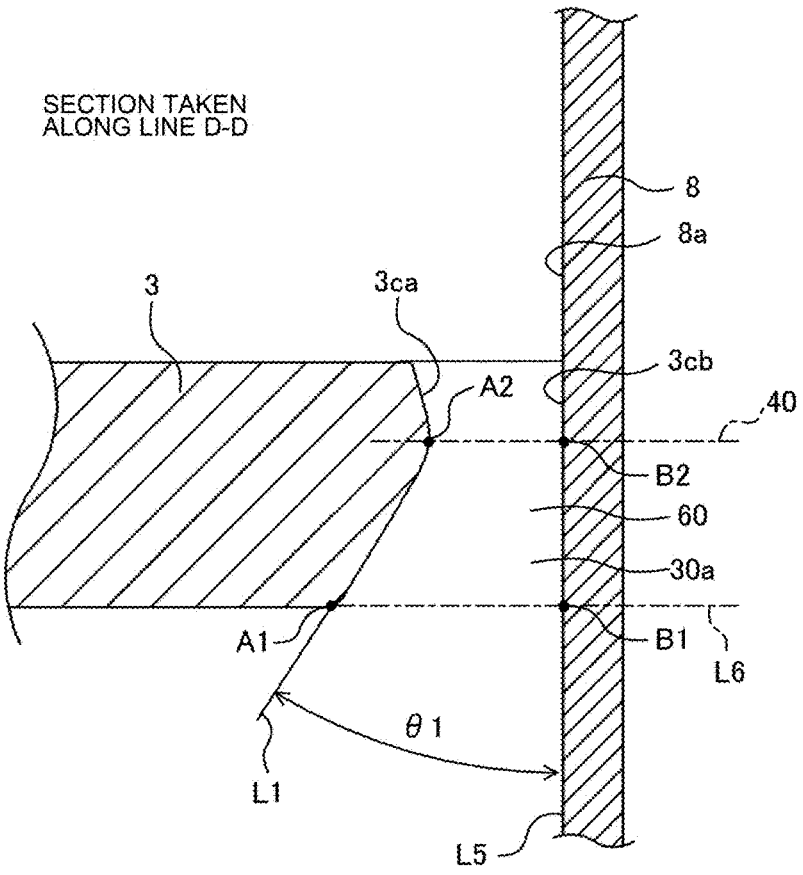
FIG. 9 is a sectional view of the scroll compressor according to Embodiment 1 that is taken along line D-D in FIG. 8, as viewed from a direction indicated by arrows.

FIG. 8 illustrates a modification of the scroll compressor 100 according to Embodiment 1, as the main frame 3 fixed to the shell 8 is viewed from the lower side. FIG. 9 is a sectional view illustrating the scroll compressor 100 according to Embodiment 1 that is taken along line D-D in FIG. 8, as viewed in a direction indicated by arrows. The up-down direction in FIG. 9 coincides with the up-down direction in FIGS. 1 and 3.

The modification of the scroll compressor 100 is a scroll compressor having no frame outer wall. The main frame 3 has protruding portions 61 that protrude outwardly from the outer circumferential surface 3Aa in the radial direction. The main frame 3 is fixed, at the protruding portions 61, to the inner wall surface 8*a* of the shell 8 by shrink fit. The protruding portions 61 are arranged at regular intervals in the circumferential direction. FIG. 8 illustrates an example in which the number of protruding portions 61 is three, but the number of the protruding portions 61 is not limited to three. In this modification, the suction port 3*c* is a groove 60 formed in the outer circumferential surface 3Aa of the main frame 3. To be more specific, the groove 60 is formed in a portion of the outer circumferential surface 3Aa of the main frame 3 that is other than the protruding portions 61. An opening surface of the groove 60 is closed by the inner wall surface 8*a* of the shell 8. Since the opening surface of the groove 60 is closed by the inner wall surface 8*a* of the shell 8, the inner wall surface of the suction port 3*c* is formed by the main frame 3 and the shell 8. Specifically, the suction port 3*c* is a hole defined by two wall surfaces 3*ca* and 3*cb* that are opposite to each other in the radial direction and by two wall surfaces 3*cc* and 3*cd* that are opposite to each other in the circumferential direction. The wall surfaces 3*ca*, 3*cd*, 3*cb*, and 3*cc* connect to each other in this order, forming the inner wall surface of the suction port 3*c*. The wall surfaces 3*ca*, 3*cd*, and 3*cc* are an inner wall surface of the groove 60 formed in the main frame 3, and the wall surface 3*cb* is the inner wall surface 8*a* of the shell 8.

As indicated in FIG. 9, the angle between the straight line L1 connecting the points A1 and A2 and a straight line L5 connecting the points B1 and B2 is θ1. The point A1 is the inlet end of the inlet portion 30*a* on the wall surface 3*ca*. The point A2 is the intersection of the cut plane 40 and the wall surface 3*ca*, at which the cross-sectional area of the flow passage of the suction port 3*c* is the minimum. The point B1 is the inlet end of the inlet portion 30*a* on the wall surface 3*cb*. Specifically, the point B1 is the intersection of the straight line L5 extending in the axial direction along the wall surface 3*cb* and a straight line L6 including the point A1 and perpendicular to the rotation shaft 5. The point B2 is the intersection of the cut plane 40 and the wall surface 3*cb*.

Also in the above configuration, the angle θ1 is set larger than or equal to 12 degrees and smaller than or equal to 100 degrees for the same reasons as described above. With this configuration, in the scroll compressor 100, it is possible to reduce separation of the flow of fluid that is sucked into the suction port 3*c*, and thus reduce the pressure loss of the fluid that is caused by the separation. It should be noted that FIG. 9 illustrates an example in which the wall surface 3*ca* of the suction port 3*c* is flat; however, the wall surface 3*ca* may be formed in the shape of a curve protruding outwardly in the radial direction in the same manner as illustrated in FIG. 4.

Figure 10:
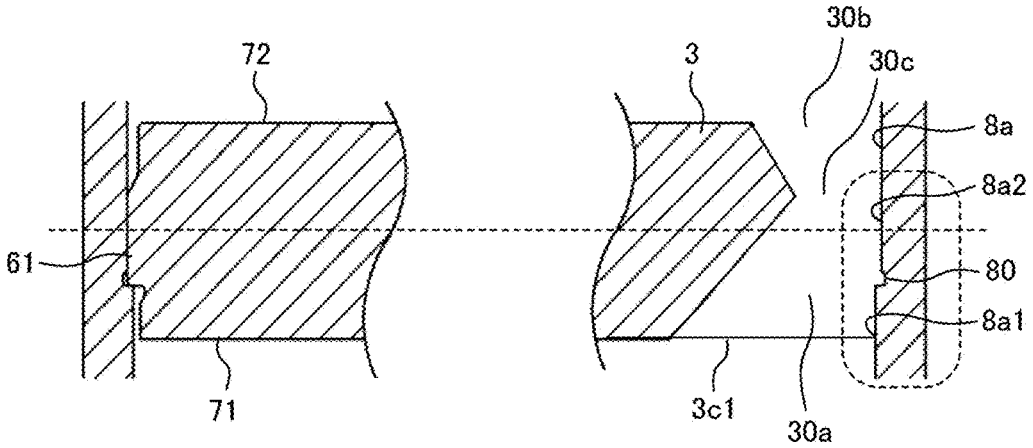
FIG. 10 is a sectional view of the scroll compressor according to Embodiment 1 that is taken along line E-E in FIG. 8, as viewed from directions indicated by arrows.
Figure 11:
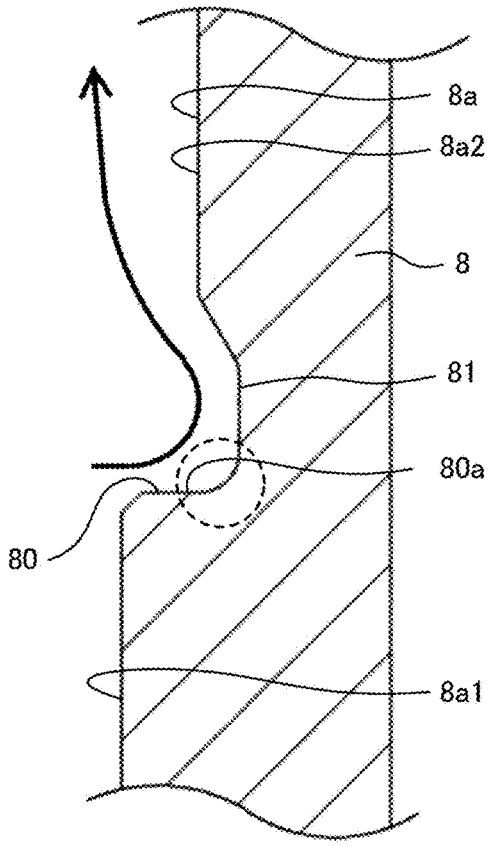
FIG. 11 is an enlarged view of a portion surrounded by a dotted line in FIG. 10.

FIG. 10 is a sectional view of the scroll compressor 100 according to Embodiment 1 that is taken along line E-E in FIG. 8 as viewed in directions indicated by arrows. In FIG. 10, an illustration of the configuration of the central portion of the main frame 3 is omitted. FIG. 11 is an enlarged view of a portion surrounded by a dotted line in FIG. 10. The scroll compressor 100 as illustrated in FIG. 10 is a scroll compressor having no frame outer wall. The inner wall surface 8*a* of the shell 8 includes a first inner wall surface 8*a*1 and a second inner wall surface 8*a*2. The second inner wall surface 8*a*2 is formed alongside of the first inner wall surface 8*a*1 in the axial direction, and is located outward of the first inner wall surface 81*a* in the radial direction. The main frame 3 is fixed to the second inner wall surface 8*a*2 by shrink fit. More specifically, the main frame 3 is fixed to the second inner wall surface 8*a*2, with the protruding portions 61 being in contact with a stepped part 80 between the first inner wall surface 8*a*1 and the second inner wall surface 8*a*2.

The stepped part 80 between the first inner wall surface 8*a*1 and the second inner wall surface 8*a*2 is used as a positioning portion at the time of fitting the main frame 3 to the second inner wall surface 8*a*2 by shrink fit. In other words, in the case where the scroll compressor 100 has no frame outer wall, the inner wall surface 8*a* of the shell 8 needs to have the stepped part 80 for use in positioning the main frame 3 during the process of shrink fit. The stepped part 80 is a portion of the flow passage defined by the suction port 3*c*. Thus, since the stepped part 80 is provided in the suction port 3*c*, the flow passage defined by the suction port 3*c* suddenly increases at the stepped part 80. In other words, since the second inner wall surface 8*a*2 is located outward of the first inner wall surface 8*a*1 in the radial direction, the width of part of the flow passage that is located downstream of the stepped part 80 is larger than that of part of the flow passage that is located upstream of the stepped part 80. When the cross-sectional area of the flow passage suddenly increases, the flow of fluid generates a swirl and thus causes a pressure loss. Accordingly, the configuration having no outer wall needs to be designed to reduce the pressure loss at the stepped part 80.

The scroll compressor 100 in Embodiment 1 is configured such that the stepped part 80 is located closer to the first surface 71 than the intermediate line between the first surface 71 and the second surface 72 of the main frame 3 in the axial direction. The dotted line extending in the lateral direction in FIG. 10 is the intermediate line between the first surface 71 and the second surface 72 of the main frame 3 in the axial direction.

The magnitude of the pressure loss of the fluid is associated mainly with the flow rate of the fluid and the expansion ratio of the cross-sectional area of part of the flow passage where the sectional area suddenly increases. The larger the expansion ratio of the cross-sectional area of the flow passage, or the higher the flow rate of the fluid, the larger the pressure loss of the fluid. It should be noted that the expansion ratio of the cross-sectional area of the flow passage is the ratio between the cross-sectional areas of portions of the flow passage that are located upstream and downstream of the stepped part 80 (the cross-sectional area of the flow passage on the downstream side/the cross-sectional area of the flow passage on the upstream side). The width by which the flow passage located downstream of the stepped part 80 is increased is constant in the axial direction. Therefore, the larger the cross-sectional area of the flow passage at the position in the axial direction where the stepped part 80 is located, the lower the expansion ratio.

Since the flow rate is inversely proportional to the cross-sectional area of the flow passage, the flow rate increases as the flow of the fluid becomes closer to the outlet end of the inlet portion 30*a* from the upstream-side opening 3*c*1 of the suction port 3*c*, that is, the flow of the fluid becomes closer to the boundary part 30*c* between the inlet portion 30*a* and the outlet portion 30*b*. Therefore, the stepped part 80 is located upstream of the boundary part 30*c* between the inlet portion 30*a* and the outlet portion 30*b* that is a location in the inlet portion 30*a* where the flow rate does not greatly increase and the cross-sectional area of the flow passage does not greatly decrease.

With this configuration, in the scroll compressor 100, it is possible to reduce the pressure loss of the fluid at the stepped part 80. It is appropriate that the stepped part 80 be located upstream of the boundary part 30*c* between the inlet portion 30*a* and the outlet portion 30*b*, also from the viewpoint of ensuring an adequate length of a shrink fit surface.

As illustrated in FIG. 11, the stepped part 80 includes a stepped surface 80*a* extending in the radial direction. At part of the second inner wall surface 8*a*2 that connects with the stepped surface 80*a*, a relief area 81 is provided. The relief area 81 is a recess that is recessed outwardly in the radial direction. The relief area 81 is provided to help the protruding portions 61 of the main frame 3 to reliably contact the stepped surface 80*a* to improve the positioning accuracy. In the case where the inner surface of the relief area 81 has, for example, a rectangular shape, separation of the flow of fluid from the inner surface occurs at the right-angled portion. In view of that, part of the relief area 81 that is extended from the stepped surface 80*a* (part surrounded by a dotted line in FIG. 11) is formed in a rounded shape. With this configuration, in the scroll compressor 100, it is possible to produce a flow of fluid along the relief area 81 in a manner indicated by an arrow in FIG. 11, and thus reduce separation of the fluid at the relief area 81.

Advantages of Embodiment 1

The scroll compressor 100 in Embodiment 1 includes: the shell 8; the compression mechanism unit 31 located inside the shell 8, and having the compression chamber 9 configured to compress fluid drawn in from the fluid intake 31*a*; the drive mechanism unit 32 configured to drive the compression mechanism unit 31; and the rotation shaft 5 configured to be rotated by a driving force generated in the drive mechanism unit 32. The scroll compressor 100 further includes the main frame 3 having an outer circumferential surface that is in contact with and fixed to the inner wall surface 8*a* of the shell 8. The main frames supports the compression mechanism unit 31 in the axial direction of the rotation shaft 5. In the main frame 3, the suction port 3*c* is formed to guide fluid sucked into the shell 8 to the compression chamber 9. The suction port 3*c* is a through hole formed in the outer circumferential portion of the main frame 3, or is defined by the inner wall surface 8*a* of the shell 8 and the groove 60 formed in the outer circumferential surface 3Aa of the main frame 3. The suction port 3*c* has: the inlet portion 30*a* where the cross-sectional area of the flow passage decreases from the upstream-side opening 3*c*1 of the suction port 3*c*; and the outlet portion 30*b* formed continuously from the inlet portion 30*a* to the downstream-side opening 3*c*2 of the suction port 3*c*, where the cross-sectional area of the flow passage increases. The main frame 3 has the first surface 71 where the upstream-side opening 3*c*1 of the suction port 3*c* is formed, the first surface 71 being perpendicular to the rotation shaft 5, and the second surface 72 that is opposite to the first surface 71 in the axial direction. The boundary part between the inlet portion 30*a* and the outlet portion 30*b* is located closer to the second surface 72 than the intermediate line between the first surface 71 and the second surface 72 in the axial direction, and the wall surface of the outlet portion 30*b*, which is located on the inner side in the radial direction perpendicular to the axial direction, is an inclined surface that is inclined inwardly in the radial direction as the wall surface extends from the upstream side toward the downstream side.

In such a manner as described above, the boundary part between the inlet portion 30*a* and the outlet portion 30*b* is located closer to the second surface 72 than the intermediate line between the first surface 71 and the second surface 72 in the axial direction. With this configuration, in the scroll compressor 100, it is possible to reduce the pressure loss, since the ratio of the inlet portion 30*a*, where the cross-sectional area of the flow passage decreases, to the suction port 3*c*, is high, and the inner wall surface of the inlet portion 30*a* gradually changes. In addition, the wall surface of the outlet portion 30*b*, which is located on the inner side in the radial direction perpendicular to the axial direction, is an inclined surface that is inclined inwardly in the radial direction, in the direction from the upstream side toward the downstream side. With this configuration, in the scroll compressor 100, the fluid flowing out from the outlet portion 30*b* is made to flow toward the fluid intake 31*a*, and the refrigerant intake efficiency can thus be improved. Since the above advantages can be obtained, the scroll compressor 100 can reduce lowering of the compressor efficiency.

In the scroll compressor 100, one or both of the angle θ1 between the straight line L1 and the straight line L2 and the angle θ2 between the straight line L3 and the straight line L4 are larger than or equal to 12 degrees and smaller than or equal to 100 degrees. The straight line L1 connects the inlet end A1 of the inlet portion 30*a* and the outlet end A2 of the inlet portion 30*a* on the wall surface 30*ca* located on the inner side in the radial direction, which is one of the two wall surfaces located opposite to each other at the section of the suction port 3*c* that is taken along the plane including the shaft center O of the rotation shaft 5. The straight line L2 connects the inlet end B1 of the inlet portion 30*a* and the outlet end B2 of the inlet portion 30*a* on the wall surface 30*cb* located on the outer side in the radial direction, which is the other of the two wall surfaces located opposite to each other at the section of the suction port 3*c* that is taken along the plane including the shaft center O of the rotation shaft 5. The straight line L3 connects the inlet end A3 of the inlet portion 30*a* and the outlet end A4 of the inlet portion 30*a* on one of the two wall surfaces. The straight line L4 connects the inlet end B3 of the inlet portion 30*a* and the outlet end B4 of the inlet portion 30*a* on the other of the two wall surfaces located opposite to each other on the section of the suction port 3*c* that is taken along the surface formed in the shape of the imaginary cylinder that has the rotation shaft 5 as the central axis.

With this configuration, it is possible to reduce separation of the flow of fluid that is sucked into the suction port 3*c*, and thus reduce the pressure loss of the fluid that is caused by the separation. As a result, the scroll compressor 100 can reduce lowering of the efficiency of the compressor. It is possible to shape the suction port 3*c* by using, for example, a casting die, and thus reduce an excessive number of manufacturing processes and the costs.

At the section of the suction port 3*c* that is taken along the plane including the shaft center O of the rotation shaft 5 (the section illustrated in FIG. 4), a wall surface from the point A1 to the point A2 is formed in the shape of a curve that protrudes outwardly in in the radial direction relative to the straight line L1. At the cross section of the suction port 3*c* that is taken along the plane including the shaft center O of the rotation shaft 5 (the cross section illustrated in FIG. 4), a wall surface located from the point A2 to the point C1 has a curved shape protruding outwardly in the radial direction relative to the straight line Lo connecting the point A2 and the point C1. It should be noted that the point C1 refers to a point at the outlet end of the outlet portion 30*b* on a wall surface located on the inner side in the radial direction, which is one of the two wall surfaces opposite to each other at the section of the suction port 3*c* that is taken along the plane including the shaft center O of the rotation shaft 5.

With the above configuration, in the scroll compressor 100, it is possible to reduce the occurrence of pressure loss that is caused by separation of the fluid.

The inlet corner portion 50 of the inlet portion 30*a* of the suction port 3*c* is formed in a rounded shape.

With the above configuration, in the scroll compressor 100, it is possible to greatly reduce the loss coefficient, as compared with the case where the inlet corner portion 50 is shaped right-angled, and thus reduce the pressure loss.

The radius of curvature of the inlet corner portion 50 is larger than or equal to 1 mm and is smaller than D/4, where D is the inside diameter of the shell 8.

With the above configuration, in the scroll compressor 100, it is possible to greatly reduce the loss coefficient, and thus reduce the pressure loss of the fluid.

The inner wall surface 8*a* of the shell has the first inner wall surface 8*a*1 and the second inner wall surface 8*a*2 to which the main frame 3 is fixed, the second inner wall surface 8*a*2 being formed alongside of the first inner wall surface 8a1 in the axial direction, and being located outward of the first inner wall surface 8a1 in the radial direction. The stepped part 80 between the first inner wall surface 8a1 and the second inner wall surface 8a2 is located closer to the first surface 71 than the intermediate line between the first surface 71 and the second surface 72 of the main frame 3 in the axial direction.

With the above configuration, in the scroll compressor 100, it is possible to reduce the pressure loss of the fluid at the stepped part 80.

The stepped part 80 has the stepped surface 80a extending in the radial direction, and the relief area 81 is formed at part of the second inner wall surface 8a2 that connects with the stepped surface 80a, and is formed as the recess that is recessed outwardly in the radial direction. Part of the relief area 81 that is extended from the stepped surface 80a is formed in a rounded shape.

With the above configuration, in the scroll compressor 100, it is possible to reduce separation of the fluid at the relief area 81.

REFERENCE SIGNS LIST

1: stationary scroll, 1a: discharge port, 1b: stationary scroll body, 1c: stationary base plate, 1d: sub-port, 2: orbiting scroll, 2b: orbiting scroll body, 2c: orbiting base plate, 2d: orbiting bearing portion, 3: main frame, 3A: outer wall, 3Aa: outer circumferential surface, 3A1: groove, 3a: main bearing, 3b: thrust bearing, 3c: suction port, 3c1: upstream-side opening, 3c2: downstream-side opening, 3ca: wall surface, 3cb: wall surface, 3cc: wall surface, 3cd: wall surface, 3d: rib portion, 4: sub-frame, 4a: sub-bearing, 5: rotation shaft, 5a: eccentric portion, 6: suction pipe, 7: discharge pipe, 8: shell, 8a: inner wall surface, 8a1: first inner wall surface, 8a2: second inner wall surface, 9: compression chamber, 10: discharge valve retainer, 11: discharge valve, 12: rotor, 13: stator, 14: oil reservoir, 15: oil pump, 16: low-pressure space, 17: high-pressure space, 18: Oldham ring, 19: oil circuit, 20: sub-port valve retainer, 21: sub-port valve, 30a: inlet portion, 30b: outlet portion, 30c: boundary part, 31: compression mechanism unit, 31a: fluid intake, 32: drive mechanism unit 40: cut plane, 50: inlet corner portion, 60: groove, 61: protruding portion, 71: first surface, 72: second surface, 80: stepped part, 80a: stepped surface, 100: scroll compressor, A1: inlet end, A2: outlet end, A3: inlet end, A4: outlet end, B1: inlet end, B2: outlet end, B3: inlet end, B4: outlet end, O: shaft center, R: radius of curvature, θ1: angle, θ2: angle

The invention claimed is:

1. A scroll compressor comprising:

a shell;

a compression mechanism unit provided in the shell, and including a compression chamber configured to compress fluid that is drawn in from a fluid intake;

a drive mechanism unit configured to drive the compression mechanism unit;

a rotation shaft configured to be rotated by a driving force generated in the drive mechanism unit; and a main frame having an outer circumferential surface that is in contact with and fixed to an inner wall surface of the shell, the main frame supporting the compression mechanism unit in an axial direction of the rotation shaft, wherein in the main frame, a suction port is formed to guide fluid sucked into the shell to the compression chamber, the suction port is provided as a through hole formed in an outer circumferential portion of the main frame, or is defined by the inner wall surface of the shell and a groove formed in the outer circumferential surface of the main frame, the suction port having an inlet portion and an outlet portion, the inlet portion being formed such that a cross-sectional area of a flow passage in the inlet portion decreases from an upstream-side opening of the suction port, the outlet portion being formed continuously from the inlet portion to a downstream-side opening of the suction port such that a cross-sectional area of the flow passage in the outlet portion increases, the main frame has a first surface in which the upstream-side opening of the suction port is formed, the first surface being perpendicular to the rotation shaft, and a second surface that is located opposite to the first surface in the axial direction, a boundary part between the inlet portion and the outlet portion is located closer to the second surface than an intermediate line between the first surface and the second surface in the axial direction, and a wall surface of the outlet portion that is located on an inner side in a radial direction perpendicular to the axial direction is an inclined surface that is inclined inwardly in the radial direction, in a direction from an upstream side toward a downstream side.

2. The scroll compressor of claim 1, wherein one or both of an angle θ1 between a straight line L1 and a straight line L2 and an angle θ2 between a straight line L3 and a straight line L4 are larger than or equal to 12 degrees and smaller than or equal to 100 degrees, the straight line L1 connecting a point A1 and a point A2 on a wall surface that is located on an inner side in the radial direction and that is one of two wall surfaces opposite to each other at a cross section of the suction port that is taken along a plane including a shaft center of the rotation shaft, the point A1 being an inlet end of the inlet portion, the point A2 being an outlet end of the inlet portion, the straight line L2 connecting a point B1 and a point B2 on a wall surface that is located on an outer side in the radial direction and that is an other of the two wall surfaces opposite to each other at the cross section of the suction port that is taken along the plane including the shaft center of the rotation shaft, the point B1 being an inlet end of the inlet portion, the point B2 being an outlet end of the inlet portion, the straight line L3 connecting an inlet end A3 of the inlet portion and an outlet end A4 of the inlet portion on one of two wall surfaces opposite to each other at a cross-section of the suction port that is taken along a surface formed in the shape of an imaginary cylinder having the rotation shaft as a central axis, and the straight line L4 connecting an inlet end B3 of the inlet portion and an outlet end B4 of the inlet portion on the other of the two wall surfaces opposite to each other at the cross section of the suction port that is taken along the surface formed in the shape of the imaginary cylinder having the rotation shaft as a central axis.

3. The scroll compressor of claim 2, wherein at the cross section of the suction port that is taken along the plane including the shaft center of the rotation shaft, a wall surface from the point A1 to the point A2 is formed in the shape of a curve protruding outward of the straight line L1 in the radial direction.

4. The scroll compressor of claim 2, wherein at the cross section of the suction port that is taken along the plane including the shaft center of the rotation shaft, a wall surface located from the point A2 to a point C1 is formed in the shape of a curve protruding outward of a straight line Lo connecting the point A2 and the point C1 in the radial direction, where the point C1 is a point that is an outlet end of the outlet portion at the wall surface that is located on the inner side in the radial direction and that is one of the two wall surfaces opposite to each other at the cross section of the suction port that is taken along the plane including the shaft center of the rotation shaft.

5. The scroll compressor of claim 1, wherein the inlet portion of the suction port has an inlet corner portion that is formed in a rounded shape.

6. The scroll compressor of claim 5, wherein the inlet corner portion has a radius of curvature that is larger than or equal to 1 mm and smaller than D/4, where D is an inside diameter of the shell.

7. The scroll compressor of claim 1, wherein the inner wall surface of the shell has a first inner wall surface and a second inner wall surface to which the main frame is fixed, the second inner wall surface being formed alongside of the first inner wall surface in the axial direction and located outward of the first inner wall surface in the radial direction, and a stepped part between the first inner wall surface and the second inner wall surface is located closer to the first surface than an intermediate line between the first surface and the second surface of the main frame in the axial direction.

8. The scroll compressor of claim 7, wherein the stepped part has a stepped surface extending in the radial direction, a relief area is formed at part of the second inner wall surface that connects with the stepped surface, and is formed as a recess that is recessed outwardly in the radial direction, and part of the relief area that is extended from the stepped surface is formed in a rounded shape.

* * * * *